US005522721A

United States Patent [19]

Drogue et al.

[11] Patent Number: 5,522,721

[45] Date of Patent: Jun. 4, 1996

[54] PROCESS FOR COMBUSTION IN AN INDUSTRIAL FURNACE

[75] Inventors: Sophie Drogue, Paris; Olivier Charon, Linas; Eric Duchateau, Versailles, all of France

[73] Assignee: L'Air Liquide, Societe Anonyme pour l'Etude et l'Exploitation des Procedes Georges Claude, Paris Cedex, France

[21] Appl. No.: 332,143

[22] Filed: Oct. 31, 1994

[30] Foreign Application Priority Data

Oct. 29, 1993 [FR] France ..... 93 12947

[51] Int. Cl.[6] ..... F23C 11/04

[52] U.S. Cl. ..... 431/1; 431/2; 431/8; 431/174

[58] Field of Search ..... 431/1, 174, 2, 431/8

[56] References Cited

U.S. PATENT DOCUMENTS

| | | | |
|---|---|---|---|
| 4,583,936 | 4/1986 | Krieger | 431/1 |
| 4,699,588 | 10/1987 | Zinn et al. | 431/1 |
| 4,938,684 | 7/1990 | Karl et al. | 431/1 |

FOREIGN PATENT DOCUMENTS

| | | |
|---|---|---|
| 0447300 | 9/1991 | European Pat. Off. . |
| 0524880 | 1/1993 | European Pat. Off. . |
| 2234286 | 1/1974 | Germany . |
| 877224 | 11/1981 | U.S.S.R. . |
| 1021871 | 6/1983 | U.S.S.R. . |

*Primary Examiner*—Larry Jones
*Attorney, Agent, or Firm*—Young & Thompson

[57] ABSTRACT

A process for combustion in an industrial furnace (1), using at least one burner (2; 3) supplied with combustible (4) and combustion supporting (5) fluids. The flow rate of at least one of the fluids is pulsed at a frequency comprised between 0.1 and 3 Hz. There is provided in the furnace (1) at least one pair of two burners (2A, 2B; 3A, 3B) disposed substantially confronting each other; and the fluid of the burners of a pair is pulsed in offset phase from one burner to the other. The frequency of pulsation is between 0.1 and 1 Hz. The flow rates of fluids are substantially identical for each burner (2A, 2B; 3A, 3B) of the pair. The power of the pair of burners is greater than 300 KW.

6 Claims, 1 Drawing Sheet

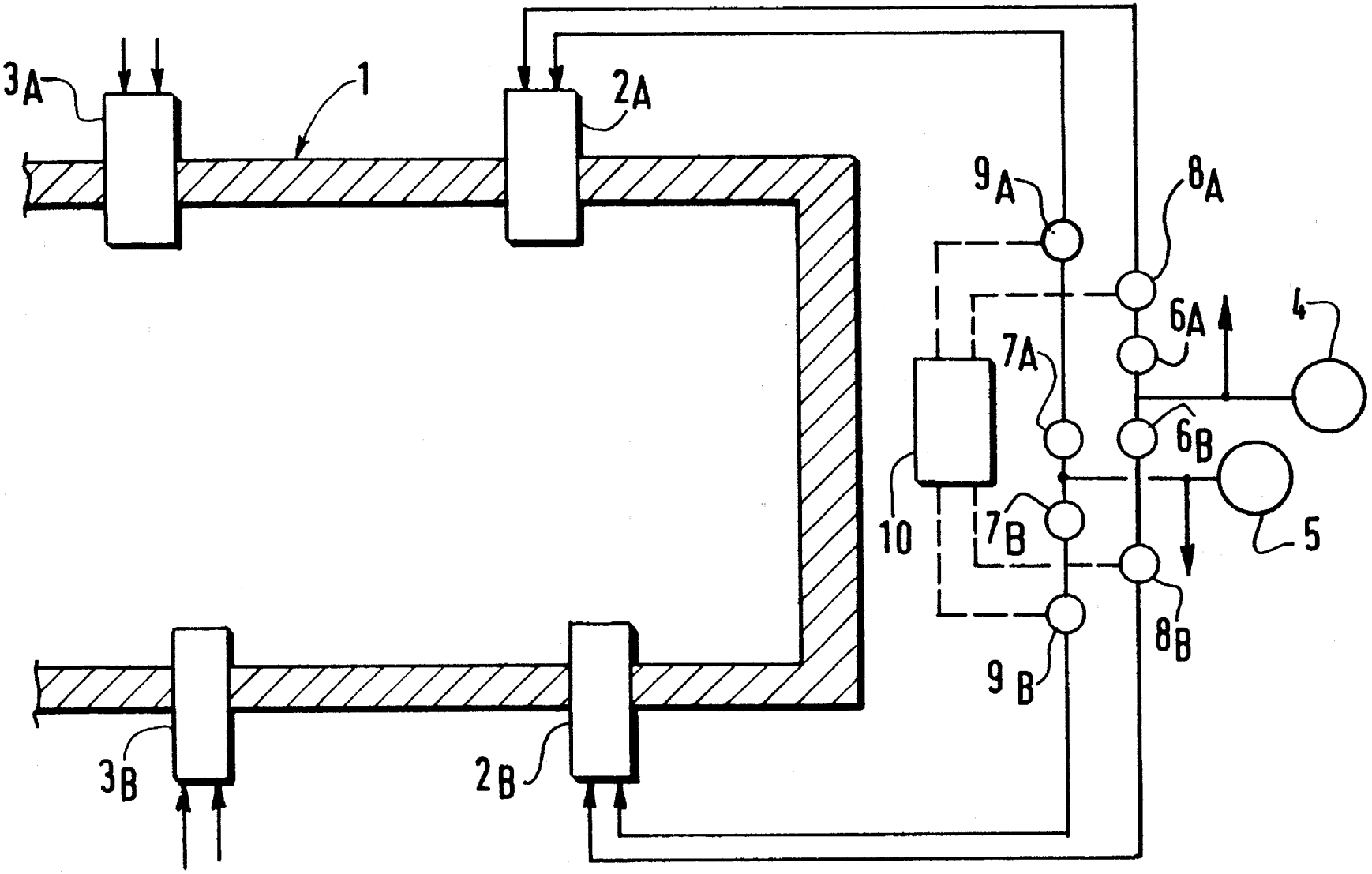
4
5
8A
6A
6B
8B
9A
7A
7B
9B
10
2A
2B
1
3A
3B

PROCESS FOR COMBUSTION IN AN INDUSTRIAL FURNACE

FIELD OF THE INVENTION

The present invention relates to processes for combustion in an industrial furnace using at least one burner supplied with combustible and combustion supporting fluids, the flow of at least one of these fluids being pulsed at a frequency comprised between 0.1 and 3 Hz.

BACKGROUND OF THE INVENTION

A process of this type is described in EP-A-0.524.880, in the name of the applicant.

The use of a burner with pulsed supply according to this document permits reducing substantially the emissions of nitrogen oxide. However, for installations of high power, with high flow rates of fluids, the reduction of nitrogen oxides is less great and there have been experienced moreover substantial variations of the volume of smoke and an increase of CO emission, which could be attributed to fluctuating and poorly controlled air inputs into the furnace.

SUMMARY OF THE INVENTION

The present invention, has precisely for its object to bring improvements to these combustion processes permitting, even for high powered burners, not only to reduce substantially emissions of nitrogen oxide, but also to minimize CO emissions and the variations of pressure within the furnace and of the volume of the smoke.

To do this, according to a characteristic of the invention, the process comprises the steps of providing, within the furnace, at least one pair of two said burners disposed substantially confronting each other and of pulsing said fluid of the burners of the pair in offset phase from one burner to the other.

According to other characteristics of the invention:

the pulsing of the fluid of the burners of the pair is effected in phase opposition, the flows of fluids as well as typically the pulsations of the fluids are identical for each burner of the pair.

BRIEF DESCRIPTION OF THE DRAWING

Other characteristics and advantages of the present invention will become apparent from the following description of an embodiment given by way of non-limiting example, with respect to the accompanying drawing, in which:

the single figure shows schematically an industrial furnace installation for practicing the process according to the invention.

DETAILED DESCRIPTION OF THE INVENTION

In the single figure will be seen an industrial furnace 1, for example a glass furnace, in which are disposed, substantially confronting each other, a first pair of burners 2A, 2B, and preferably at least one second pair of burners 3A, 3B, each pair developing a thermal power of at least 300 kw. In the description which follows, we will consider essentially the first pair of burners 2A, 2B, the supply means of the other burners 3A, 3B being identical or analogous.

Each burner 2A, 2B associated in the first pair is connected to a source 4 of combustible fluid, for example liquid or gaseous fuel, particularly natural gas, and to a source 5 of combustion supporting fluid, for example air, air enriched in oxygen or substantially pure oxygen. Each supply line for fluid to the burners 2A, 2B comprises a device 6A, 6B and 7A, 7B, for adjusting pressure and flow rate, respectively, and a pulsing means 8A, 8B, and 9A, 9B, such as is described in EP-A-0.524.880 mentioned above, controlled by a common control and calibration device 10, permitting adjusting in controlled and suitable manner the stoichiometry of each burner.

According to the invention, the pulsing means 8 and 9 are controlled to give a fluid pulsation corresponding to a 15 frequency comprised between 0.1 and 3 Hz, typically between 0.1 and 1 Hz, preferably 0.2 or 0.3 Hz.

The pulsation of the same fluid supplying the burners 2A, 2B of the pair is preferably effected in phase opposition from one burner to the other, which is to say that when one of the burners develops a substoichiometric flame, corresponding to a high flow relative to the combustion supporting fluid, the other burner develops a superstoichiometric flame, which is to say with a low relative flow rate of the combustion supporting fluid, in the case of a non-pulsed supply of combustion supporting gas, the rich flame being in direct contact with the poor flame. Moreover, for the burners of one pair, the flow rates of the fluid, the times of opening and closing of the pulsation means and the frequency of pulsation conferred by these latter are the same.

The same conditions as above are applied to the two burners 3A, 3B of another pair, the parameters of flow rate and pulsation of the burners of one pair being however independent of the parameters of the burners of another pair and being adapted to be separately adjusted.

Thus, for a pair of burners supplying a power of 1 MW by combustion of natural gas and substantially pure oxygen, with pulsation only of the flow of natural gas at a frequency of 0.2 Hz, offset by $\pi$ from one burner to the other of a same pair, there will be noted, relative to a simple pulsed burner, a reduction of nitrogen oxide emissions reaching 40%, a negligible variation of the volume of smoke, and $CO_2$ of less than 50 mg/Nm$^3$ in the smoke.

Although the present invention has been described with respect to a particular embodiment, it is not thereby limited but on the contrary is susceptible of modifications and variations which will be apparent to those skilled in the art.

We claim:

1. A combustion method for a furnace, comprising:

providing at least one pair of burners each supplied with a combustible fluid and an oxidant fluid;

arranging the burners of the pair in the furnace substantially in facing relationship; and pulsing at least one of said fluids of each burner at a frequency between 0.1 and 3 Hz, the pulsation of a burner of a pair being phase offset from the other burner of the pair.

2. A process according to claim 1, wherein said at least one fluid of each burner is pulsed in phase opposition from one burner to the other.

3. A process according to claim 1, wherein the frequency of pulsation is comprised between 0.1 and 1 Hz.

4. A process according to claim 1, wherein the flow rates of fluids are substantially identical for each burner of the pair.

5. A process according to claim 1, wherein the pulsations of the flow rate of fluids are identical for each burner of the pair.

6. A process according to claim 1, wherein the power of the pair of burners is greater than 300 KW.

* * * * *